US005093979A

United States Patent [19]

Kwapisz

[11] Patent Number: 5,093,979

[45] Date of Patent: Mar. 10, 1992

[54] METHOD FOR ASSEMBLING RELAYS

[75] Inventor: Steven J. Kwapisz, Madison Heights, Mich.

[73] Assignee: United Technologies Automotive, Inc., Dearborn, Mich.

[21] Appl. No.: 715,066

[22] Filed: Jun. 12, 1991

[51] Int. Cl.[5] ..... H01H 11/00

[52] U.S. Cl. ..... 29/602.1; 29/622; 29/756

[58] Field of Search ..... 29/602.1, 622, 468, 29/755, 757, 759, 756

[56] References Cited

U.S. PATENT DOCUMENTS 4,611,392 9/1986 Bell ..... 29/602.1

4,742,610 5/1988 Kimpel et al. ..... 29/602.1

*Primary Examiner*—Carl E. Hall

*Attorney, Agent, or Firm*—Ronald G. Cummings

[57] ABSTRACT

A method and apparatus for assembling an armature subassembly to a relay subassembly which includes (a) positioning the armature subassembly so the proximal end of the contactor is adjacent the upper wall of the relay frame and the armature is adjacent the front edge of the frame; (b) mechanically moving and holding the distal end of the contactor blade against the relay subassembly so that the armature is flush against the front edge of the frame; (c) mechanically moving and holding the proximal end of the contactor blade against the upper wall of the frame without inducing lateral movement or stress in the contactor blade; (d) relieving position-affecting stress on the contactor blade; (e) releasing the distal end of the contactor blade to assume a rest position so that the armature and front edge forms a gap; and (f) welding the proximal end of the contactor to the frame wall.

9 Claims, 2 Drawing Sheets

METHOD FOR ASSEMBLING RELAYS

TECHNICAL FIELD

This invention relates to electromechanical relays and more particularly to a method and apparatus for assembling relays having particular utility in automotive applications.

BACKGROUND AND SUMMARY OF THE INVENTION

Relays are well known electromechanical devices for circuit switching and isolation and have widespread applicability in automotive applications. A typical automotive relay has an armature subassembly which is welded to the relay frame and is actuated between conducting and nonconducting positions responsive to electrical signals. The armature subassembly of a relay comprises a generally L-shaped contactor blade mounting an armature in the form of a plate element. The geometric configuration of the contactor blade can be critical to the performance of the relay and Kwapisz, U.S. Pat. No. 4,959,784 issued Sept. 25, 1990 entitled "Method and System for Adjusting Relay Armatures" (which is incorporated by reference) discloses a method and apparatus for adjusting the armature subassembly after it has been welded to the relay.

Of particular importance to the performance of a relay is the relay armature-frame gap. The relay armature-frame gap is the separation or air gap between the armature and the frame which is necessary to prevent mechanical binding during operation. In assembly, the armature is more or less "floating", being mounted to the distal end of the contactor blade and movable in one direction by a magnetic actuating force and in the other direction by the spring bias of the contactor blade. It is very important to the performance of a relay that an even or uniform gap be formed to prevent mechanical binding.

Previous apparatus and methods for assembling relays have not been entirely satisfactory in consistently producing a proper gap. From a manufacturing standpoint, improper gaps result in undesirable component performance or costly component rejection and/or repair.

Accordingly, it is an object of the present invention to provide a new and improved method and apparatus for relay assembly which achieves enhanced control of the formation of the relay armature-frame gap.

Another object of the invention is to provide such a method and apparatus which produces an even or uniform gap to prevent mechanical binding during the operation of the relay.

Another object of the invention is to provide such a method of assembly which is particularly adapted for automated assembly.

Other objects will be in part obvious and in part pointed out more in detail hereinafter.

It has been found that the foregoing disadvantages of the prior art are overcome in a method of assembling a relay which includes positioning the armature subassembly so that the proximal end of the contactor blade is adjacent the upper wall of the relay frame and the armature is adjacent to the front edge of the frame. The distal end of the contactor blade is mechanically positioned and held against the relay subassembly so that the armature is aligned flush against the front edge of the frame. The proximal end of the contactor blade is held against the upper wall of the frame and the distal end of the contactor blade is then released to assume a rest position so that the armature and front edge forms an even gap before welding the proximal end of the contactor blade to the frame. Prior to releasing the distal end of the contactor blade, the proximal end of the contactor blade is released to relieve position-affecting stress on the contactor blade and then the proximal end is held against the upper wall in a manner so as to prevent stress on the contactor which would deleteriously affect the armature-frame gap.

DESCRIPTION OF THE PREFERRED EMBODIMENT

Figure 1:
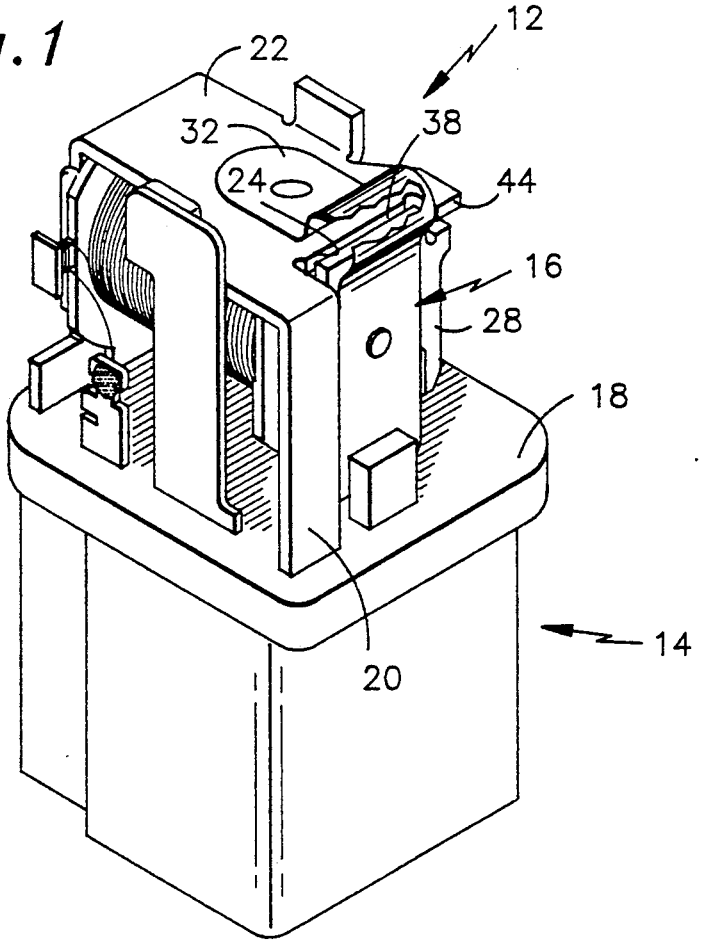
FIG. 1 is a perspective view, partly broken away, of an automotive relay.

Although specific forms of the present invention have been selected for illustration in the drawings, and the following description is drawn in specific terms for the purpose of describing these forms of the invention, the description is not intended to limit the scope of the invention which is defined in the appended claims.

Referring to FIG. 1, a conventional automotive relay 12 is shown which comprises, for purposes of describing the present invention, a relay subassembly 14 and an armature subassembly 16. The relay subassembly 14 includes a base 18 supporting a metal frame 20. The frame 20 has an upper wall 22 and a front edge 24.

Figure 2:
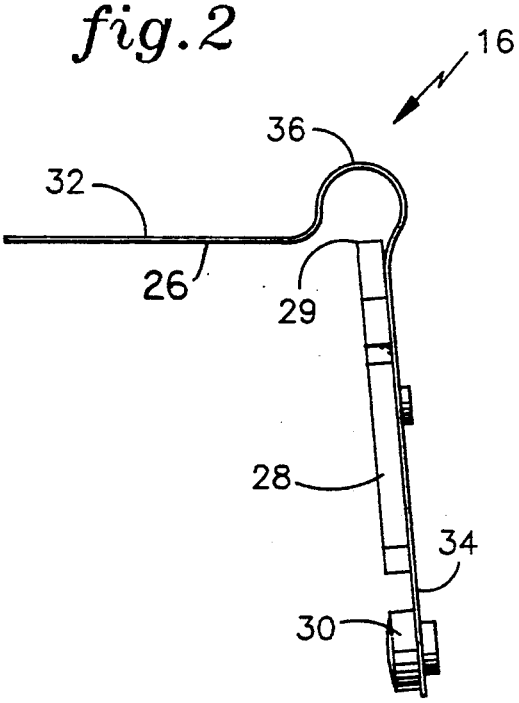
FIG. 2 is a side view of an armature subassembly.

Referring to FIG. 2, the armature subassembly 16 generally comprises a contactor blade 26, armature 28 and contactor 30. The contactor blade 20 is generally L-shaped comprising a proximal end section or leg 32, a distal end section or leg 34 and an interconnecting spring loop 36. The armature 28 is welded to the distal end section 34 and is formed as a plate element adapted for magnetic attraction to the core head (not shown) of the relay.

In assembly, the armature subassembly 16 is mounted to the relay subassembly 14 by welding the proximal end 3 of the contactor blade 26 to the upper wall 22 of the frame 20. The armature subassembly 16 and frame 20 are intended to be relatively disposed so as to form a predetermined separation or gap 38 between the front edge 24 of the upper wall 22 and the upper inner edge 29 of the armature 28 (FIG. 2). An even gap 38 is important to prevent mechanical binding and insure satisfactory operation of the relay.

In prior assembly processes, the armature subassembly 16 is manually positioned on the relay subassembly such that the proximal end 32 of the contactor blade is positioned on the upper wall 22 and the armature 28 is pushed against the front edge 24 of the frame 20. The relay subassembly 14 is mounted to a support structure on a bar slide and a hold-down finger slide extends forward to engage and retain the proximal end 32 against the upper wall 22. The relay coil is electrically energized to magnetically draw the armature 28 inwardly against the core head (not shown). A pair of armature guides extend inwardly to engage the opposite sides 40, 42 to center the armature 28 between forwardly protruding caps 44 of the top wall 22. The finger slide is withdrawn to make way for the welding electrode and ground and the magnetic attraction of the armature 28 toward the core head represents the means for retaining the armature subassembly in place until the welding electrode engages the proximal end 32. After the weld electrode engages the proximal end 32, the core head is de-energized to release the armature 28 and the distal end 34 assumes a rest position under the biasing influence of the spring loop 36. At this point, the weld electrode is holding the contactor blade in place and is energized to weld the proximal end to the relay frame. The weld electrode is then withdrawn.

Accordingly, the foregoing represents a general description of a prior process for positioning and securing the armature subassembly to the relay frame. In such a process, an unacceptable gap may result from initial misalignment of the armature to the frame, movement or stress to the contactor blade from engagement with the weld electrode, or other induced stress in the contactor blade.

Figure 4:
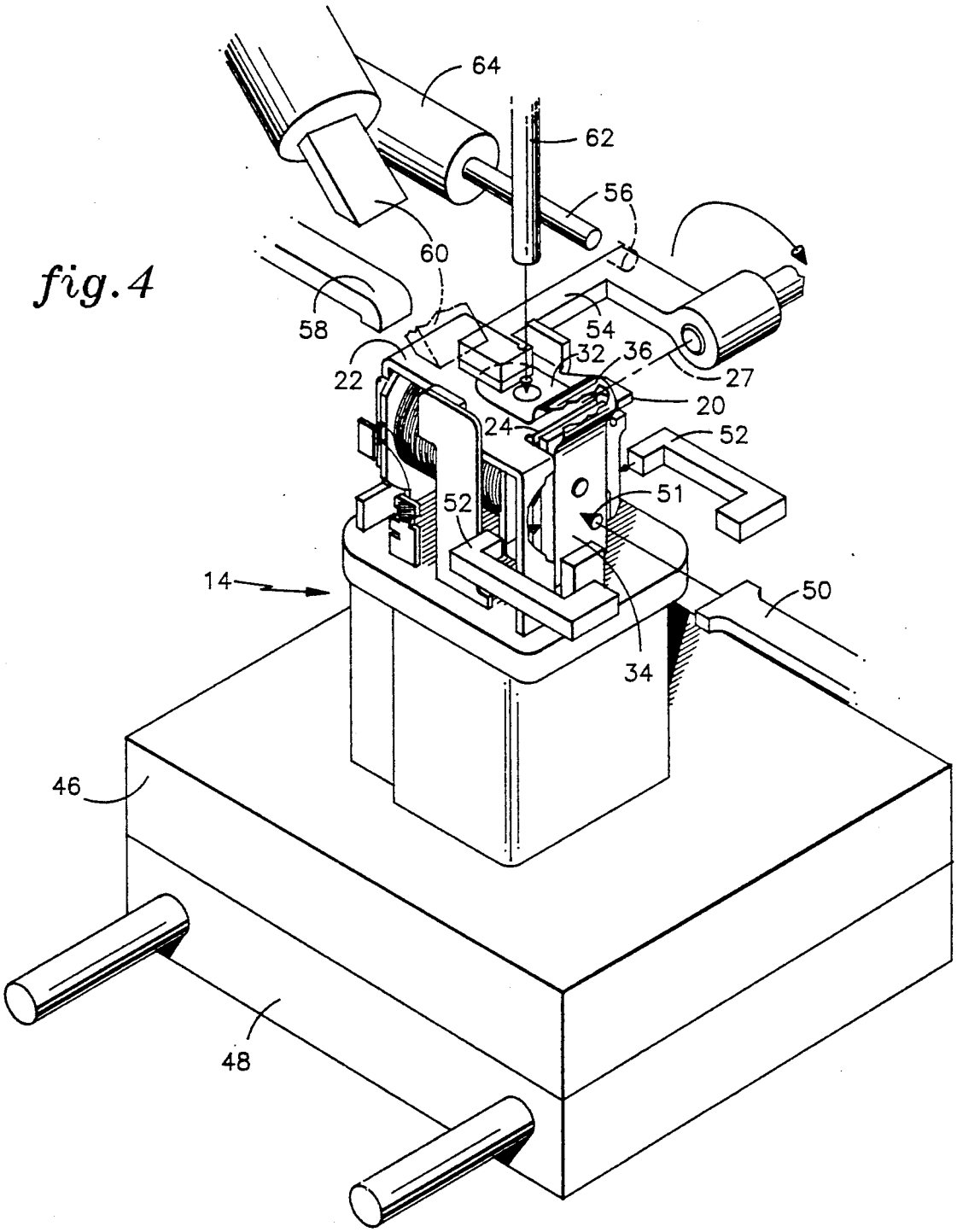
FIG. 4 is a perspective diagrammatical view of the assembly apparatus of the present invention.

Referring to FIG. 4, the assembly apparatus of the present invention generally comprises a fixture support 46 on a bar slide 48, a T-shaped pushrod 50, a pair of opposed armature alignment guides 52, a rotary hold-down arm 54, a retractable rotary arm limit 56, a hold-down finger slide 58, a high pressure ground electrode 60 and a weld electrode 62. The structure and operation of these components is best described relative to the process of assembling an armature subassembly to a relay subassembly.

The armature subassembly is manually held in position on the relay subassembly 14 which is secured on the support fixture 46 by clamps (not shown). The finger slide 58 is a spring-loaded hold-down finger and is pushed over the proximal end 32 of the contactor blade while manual pressure is applied on the loop 36 to maintain the armature 28 flush against the frame edge 24. The finger slide 58 now holds the proximal end 32 of the contactor blade against the upper wall 22 of the frame. From this point, the assembly process may be fully automated. A conventional programmable control may be utilized with all operations except welding being pneumatic and mechanical.

In operation, the bar slide 48 is actuated to laterally position the relay subassembly 14 relative to the weld electrode 62. The T-shaped pushrod 50 extends (as indicated by direction arrow 51) so that the broad terminal end of the pushrod engages the distal end 34 of the contactor blade and pushes the distal end 34 so that the armature 28 is flush against the frame edge 24 and the core head (not shown). The broad terminal end of the pushrod (i.e., the cap of the "T") insures that the armature will be held flush against the frame edge 24. Retaining the armature flush against the frame edge is important to consistently forming an even gap. By retaining the armature flush against the frame edge, the armature is necessarily parallel to the frame edge so that an even gap will be formed if the distal end of the contactor blade moves directly outwardly from the relay frame when the distal end assumes a rest position.

Figure 3:
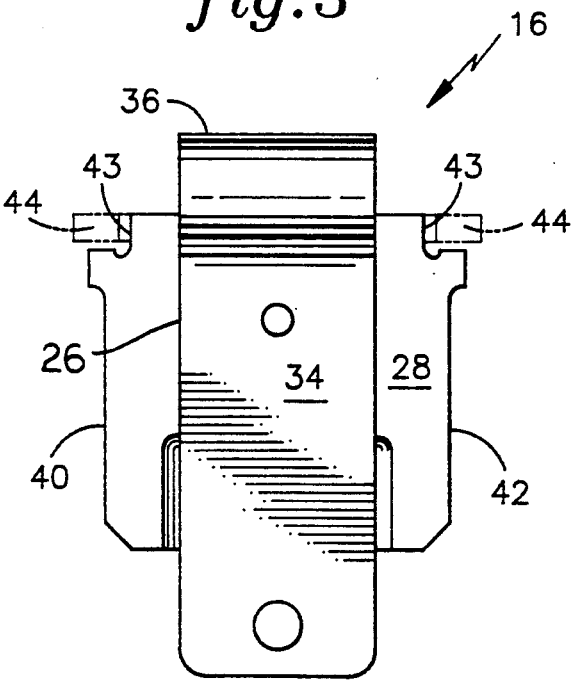
FIG. 3 is a front view of the armature subassembly of FIG. 2 with a portion of a relay frame in broken line.

The armature guides 52 are then actuated to engage the opposite sides 40, 42 of the armature 28 (FIG. 3) to center the armature 28 vertically between the frame tabs 44. Centering the armature 28 between the frame tabs 44 prevents the edges 43 of the armature from binding with the frame during operation.

With the pushrod 50 holding the armature against the relay frame, the finger slide 58 retracts out of engagement with the proximal end 32 of the contactor blade. The rotary arm rotates downwardly to hold the proximal end 32 of the contactor blade against the upper wall 22 of the frame 20. The rotary arm 54 is configured to rotate substantially about the pivot axis 27 of the contactor blade 26 so that side forces and stress are not imparted to the contactor blade by the rotary arm so as to misalign the armature and deleteriously affect the gap. By rotating the arm 54 about the pivot axis of the contactor blade, the arm 54 follows the same path as the proximal end 32 down to the frame surface 22 and the force applied by the arm 54 will be generally perpendicular to the proximal end so no side forces or stress will be imparted to the contactor blade.

An arm limiting shaft 56 is extended by an air cylinder 64 to provide a limit for upward rotation of the rotary arm 54. Since the rotary arm will temporarily retract from the contactor blade later on in the assembly process, the limit shaft 56 will save time by limiting the distance of retraction of the rotary arm.

With the proximal end 32 of the contactor blade being held against the frame wall 22 by the rotary arm 54, the pushrod 50 retracts out of engagement with the distal end 34 of the contactor blade and the ground electrode extends into engagement with the frame wall 22 (as shown in broken line in FIG. 4). The ground electrode 60 is a high pressure ground which exerts substantial force on the relay frame 20. As a result, the high pressure ground. pushes the relay subassembly downwardly a small amount due to the flexing of the material of support fixture 46. The pushrod 50 was retracted prior to this downward movement of the relay subassembly in order to allow the armature subassembly to remain properly positioned on the relay subassembly as it is being depressed slightly.

After the ground electrode 60 has fully engaged the frame wall 22, the pushrod 50 is again extended into engagement with the distal end 34 to push the armature 28 flush against the frame edge 24 and the core head. At this point, the rotary arm now retracts from the proximal end 32 to relieve any stress induced in the contactor blade such as stress due to the pushrod 50 pushing on the contactor blade. Stress in the proximal end (i.e., behind the loop 36) can result in no gap, a non-uniform gap and binding. The retraction of the rotary arm 54 is limited by the limit shaft 56 to reduce cycle time.

After retracting to relieve stress in the contactor blade, the rotary arm 54 rotates downwardly to again engage and hold the proximal end 32 against the frame wall 22. The pushrod 50 now retracts from the distal end 34 to allow the distal end 34 to spring directly outwardly and assume its rest position with an even predetermined gap being formed between the armature and frame edge 24.

With the proper gap being formed, the weld electrode 62 extends downwardly onto the proximal end 32. No side force or stress is imparted to the proximal end 32 by the weld electrode because the proximal end is being held against the frame wall 22 by the rotary arm 54. The rotary arm 54 retracts away from the proximal end 32 and rests on the limit shaft 56. The weld electrode 62 is activated to weld the proximal end 32 to the frame wall 22. The engagement and actuation of the weld electrode 62 and the retraction of the rotary arm 54 may be timed to occur during the same operational step.

At this point, the welding process is complete and the weld electrode 62 retracts upwardly, the ground electrode 60 retracts, and the rotary arm limit 56 retracts to allow the rotary arm 54 to return to its rest position. The armature guides 52 retract from the armature sides and the bar slide 48 retracts to move the assembled relay away from the immediate assembly area. The assembly process is completed and the relay is now ready to be removed for function check.

In assembling the armature subassembly to the relay subassembly, the pushrod 50 operates to hold the armature flush against the frame edge 24. Thus, the armature is parallel to the frame edge 24 and should produce a uniform gap between the armature and frame when the distal end of the contactor blade assumes a rest position. During the positioning process, any position-altering stress induced in the contactor blade is relieved prior to welding the proximal end. The rotary arm 54 is specifically configured to hold down the proximal end 32 without inducing position-affecting stress in the contactor blade so that an even gap is formed when the distal end 34 is released. Misalignment in the welding process is thereby reduced or eliminated.

As can be seen, a method and apparatus for assembling relays has been described which effectively controls the formation of the relay armature-frame gap to consistently provide an even gap which prevents binding and unacceptable relay performance. Furthermore, the method of assembly is particularly adapted for automated assembly.

As will be apparent to persons skilled in the art, various modifications and adaptations of the structure above described will become readily apparent without departure from the spirit and scope of the invention, the scope of which is defined in the appended claims.

What is claimed is:

1. A method of assembling an armature subassembly to a relay subassembly where the armature subassembly has a contactor blade with distal and proximal ends and an armature mounted to said distal end and the relay subassembly has a frame with an upper wall and a front edge for forming a gap with the armature, the method comprising (a) positioning the armature subassembly so that the proximal end of the contactor blade is adjacent the upper wall of the frame and the armature is adjacent the front edge of the frame;

(b) holding the distal end of the contactor blade against the relay subassembly so that the armature is aligned parallel to the front edge of the frame;

(c) holding the proximal end of the contactor blade against the upper wall of the frame; (d) releasing the distal end of the contactor blade to assume a rest position so that the armature and front edge forms a gap; and (e) affixing the proximal end of the contactor blade to the upper wall.

2. The method of claim 1 wherein the step of holding the distal end of the contactor blade comprises mechanically moving and retaining the distal end of the contactor blade against the relay subassembly.

3. The method of claim 2 wherein moving and retaining the distal end of the contactor blade against the relay subassembly comprises pushing the distal end so that the armature is flush against the front edge of the frame.

4. A method of assembling an armature subassembly to a relay subassembly where the armature subassembly has a contactor blade with distal and proximal ends and an armature mounted to said distal end and the relay subassembly has a frame with an upper wall and a front edge for forming a gap with the armature, the method comprising (a) positioning the armature subassembly so that the proximal end of the contactor blade is adjacent the upper wall of the frame and the armature is adjacent the front edge of the frame;

(b) holding the distal end of the contactor blade against the relay subassembly so that the armature is aligned for forming a gap with the front edge of the frame;

(c) holding the proximal end of the contactor blade against the upper wall of the frame;

(d) relieving position-affecting stress on the contactor blade by first releasing the proximal end of the contactor blade to assume a rest position and then mechanically moving and retaining the proximal end against the upper wall of the frame without producing stress or lateral movement of said proximal end; and (e) affixing the proximal end of the contactor blade to the upper wall.

5. The method of claim 4 wherein the contactor blade has a pivot axis and the step of mechanically moving and retaining said proximal end against the upper wall of the frame comprises applying angular force to the proximal end about the pivot axis of the contactor blade to move and retain the proximal end against the upper wall.

6. The method of claim 4 wherein the step of mechanically moving the proximal end comprises applying motive force perpendicular to the proximal end of the contactor blade.

7. A method of assembling an armature subassembly to a relay subassembly where the armature subassembly has a contactor blade with distal and proximal ends and an armature mounted to said distal end and the relay subassembly has a frame with an upper wall and a front edge for forming a gap with the armature, the method comprising:

(a) positioning the armature subassembly so that the proximal end of the contactor blade is adjacent the upper wall of the frame and the armature is adjacent the front edge of the frame;

(b) holding the distal end of the contactor blade against the relay subassembly so that the armature is aligned parallel to the front edge of the frame, said holding the distal end comprising mechanically moving and retaining the distal end of the contactor blade against the relay subassembly.

(c) holding the proximal end of the contactor blade against the upper wall of the frame;

relieving position-effecting stress on the contactor blade prior to releasing the distal end of the contactor blade.

(e) releasing the distal end of the contactor blade to assume a rest position so that the armature and front edge forms a gap; and (f) affixing the proximal end of the contactor blade to the upper wall.

8. The method of claim 7 wherein the step of holding the proximal end of the contactor blade comprises mechanically retaining the proximal end against the upper wall; and the step of relieving position-affecting stress comprises releasing the proximal end of the contactor blade to assume a rest position and then mechanically moving and retaining said proximal end against the upper wall of the frame.

9. The method of claim 8 wherein the contactor blade has a pivot axis and the step of mechanically moving and retaining said proximal end against the upper wall of the frame comprises applying angular force to the proximal end about the pivot axis of the contactor blade to move and retain the proximal end against the upper wall.

* * * * *